US006389914B1

(12) United States Patent
Hiruma et al.

(10) Patent No.: US 6,389,914 B1
(45) Date of Patent: May 21, 2002

(54) ONE-AXIS STARTER APPARATUS

(75) Inventors: Hiroshi Hiruma, Kiryu; Kenichi Yokoyama, Seta-gun; Kazuo Iwashita; Yoshinori Kojima, both of Kiryu, all of (JP)

(73) Assignee: Mitsuba Corporation, Kiryu (JP)

( * ) Notice: Subject to any disclaimer, the term of this patent is extended or adjusted under 35 U.S.C. 154(b) by 0 days.

(21) Appl. No.: 09/604,789

(22) Filed: Jun. 28, 2000

(30) Foreign Application Priority Data

Jun. 29, 1999 (JP) ..... 11-183775

(51) Int. Cl.[7] ..... F02N 11/00
(52) U.S. Cl. ..... 74/7 R; 74/7 C
(58) Field of Search ..... 74/6, 7 R, 7 C

(56) References Cited

U.S. PATENT DOCUMENTS

| | | | | |
|---|---|---|---|---|
| 2,907,216 A | * | 10/1959 | Smith | 74/7 R |
| 3,630,092 A | * | 12/1971 | Matsumoto et al. | 74/7 R X |
| 4,326,429 A | * | 4/1982 | Mortensen | 74/7 R |
| 4,346,615 A | * | 8/1982 | Yoneda et al. | 74/7 R X |
| 5,241,871 A | * | 9/1993 | McKnight et al. | 74/7 C |

FOREIGN PATENT DOCUMENTS

| | | | | |
|---|---|---|---|---|
| CA | 675291 | * | 12/1963 | 74/7 R |
| DE | 637958 | * | 11/1936 | 74/7 R |
| FR | 805562 | * | 11/1936 | 74/7 C |

* cited by examiner

*Primary Examiner*—Rodney H. Bonck
*Assistant Examiner*—Ha Ho
(74) *Attorney, Agent, or Firm*—Oliff & Berridge PLC

(57) ABSTRACT

The invention relates to a one-axis starter apparatus which can eliminate the use of a one-way rotation clutch and simplify the machining of the motor shaft, wherein while the first male helical spline is provided at the tip end of the motor shaft, the inner member is externally provided at the tip end portion of the corresponding motor shaft via the first female helical spline. The second male helical spline is provided in the screwing direction opposite to the first male and female helical splines, respectively, on the outer circumferential surface of the inner member, whereas the outer member, having a pinion gear formed thereon via the second female helical spline, is externally fitted to the corresponding inner member, and a pressing mechanism which presses the outer member toward the tip end o the starter apparatus intervenes between the corresponding outer member and the inner member.

12 Claims, 4 Drawing Sheets

ONE-AXIS STARTER APPARATUS

BACKGROUND OF THE INVENTION

1. Field of Invention

The invention relates to a one-axis starter apparatus in an internal combustion engine for automobiles, motor cycles or other fuel powered vehicles.

2. Description of Related Art

Generally, with this type of starter apparatus, known as an inertia sliding type or a so-called Bendix-type, a pinion gear engaged with a ring gear (driven gear) at the internal combustion engine side is directly provided at the tip end of a starter motor shaft via a helical spline. In line with the rotation drive of the Bendix-type starter motor, the starter motor is disengageably engaged with the pinion gear by inertia sliding (advancement and retreat) of the pinion gear on the starter motor shaft. However, in this Bendix-type, having engagement of the ring gear and the pinion gear, when the rotation at the ring gear exceeds that at the pinion gear, the pinion gear slides on the motor shaft by inertia, making a quick return and thereby risking an unstable or canceled engagement between the ring gear and the pinion gear. Therefore, a one-way rotation clutch is proposed to intervene between the pinion gear and the motor shaft to prevent the quick return of the pinion gear. Such a one-way rotation clutch, as shown in FIG. 4, is already known. A typical one-way rotation clutch is a roller type, in which a pinion gear 17*a* is formed at a clutch inner member 17 that is slidably externally fitted to the motor shaft 16. The roller type clutch has a helical spline 18*a* formed in the clutch outer member 18 to be fitted to a helical spline 16*a* located at the tip end of the motor shaft 16, whereby a clutch roller 19 intervenes between the clutch inner member 17 and the clutch outer member 18. In addition, in this type of one-way rotation clutch, where the rotation of the ring gear, i.e., the driven gear, exceeds that of the pinion gear 17*a*, the clutch roller is disconnected, whereby a quick return of the pinion gear 17*a* is prevented by avoiding rotation loads on the clutch outer member 18 while the clutch inner member 17 is permitted to rotate freely.

In prior art starter motors, the clutch device is expensive, resulting in increased production costs, as well as a cumbersome assembly process. Further, the prior art clutch devices require a bearing 20 that is pressure-fitted onto the inner circumferential surface of the clutch inner member 17 so that sliding is enabled between the clutch inner member 17 and the motor shaft 16. Further still, prior clutch devices require a motor shaft having an axial portion 16*b* with a smaller diameter than the diameter of the helical spline 16*a* formed at the tip of the motor shaft so that a gap is produced between the axial portion 16*b* and the helical spline 16*a* of the motor shaft. The shaping or cutting of the axial portion and helical spline of the motor shaft not only requires more work time, but also may negate the strength of the motor shaft 16. Therefore, to compensate for a lowering in strength, a material having high strength must be used or the motor shaft as a whole must be enlarged. This too results in increased production costs or an upsizing of the apparatus.

To overcome some of the problems of the prior art, as has been disclosed in Japanese Laid-Open Patent Publication No. 117166 of 1988, a one-axis starter apparatus that does not require any roller type one-way rotation clutch has been developed. This type of starter apparatus uses a friction member and is composed of a friction plate by which an outer member, having a pinion gear formed therein, is externally fitted to an inner member provided with a helical spline fitted to the motor shaft, and which friction member intervenes between the inner member and outer member. A coned disk spring resiliently presses the outer member to the friction member side. However, in this friction member type starter apparatus, where rotation of the outer member exceeds that of the inner member, the outer member rotates idly against the friction force of the friction member, to prevent the inner member from a quick return along with the outer member. As described above, this friction member type starter apparatus eliminates the need of any roller type one-way rotation clutch. But, it is also requires making the tip end of the motor shaft smaller in diameter so that the inner circumferential surface on which a helical spline is formed does not interfere with the motor shaft where the inner member slides toward the tip end. Thus, as in the related art set forth in the above description, the problems of increased production costs due to increased machining time of the differently diametered motor shaft or due to the necessity of increasing the size and strength of the motor shaft or its materials in the alternative still remain.

SUMMARY OF THE INVENTION

The invention has been developed to solve the problems identified in view of the above situations. The invention relates to a one-axis starter apparatus having an inner member fitted externally to a motor shaft of a starter motor via a first helical spline so as to freely advance and retreat, and having an outer member on which a pinion gear is disengageably engaged with a driven ring gear on the basis of the advance and retreat of said inner member, and which outer member is externally fitted thereto, wherein the outer member is pressed toward the driven ring gear by a pressing means in a state where its movement towards the driven ring gear is regulated with respect to the inner member, and is externally fitted to the inner member via a second helical spline reversely oriented from the first helical spline.

With the above construction, an impact due to engagement with the ring gear can be lightened, and a quick return of the pinion gear can be prevented. A quick return preventing means, such as a one-way rotation clutch, is therefore not required.

In the starter apparatus thus structured, the first helical spline of the motor shaft according to the invention is provided to the tip end of the motor shaft beyond the area where the inner member freely advances and retreats, whereby the cutting of the motor shaft is simplified, and there is no problem in which the strength of the motor shaft is lowered due to provision of an axial portion having a smaller diameter than the helical spline portion.

Further, in the starter apparatus, the pressing means according to the invention may be composed of two overlapped coned disk springs.

DETAILED DESCRIPTION OF PREFERRED EMBODIMENTS

Figure 1:
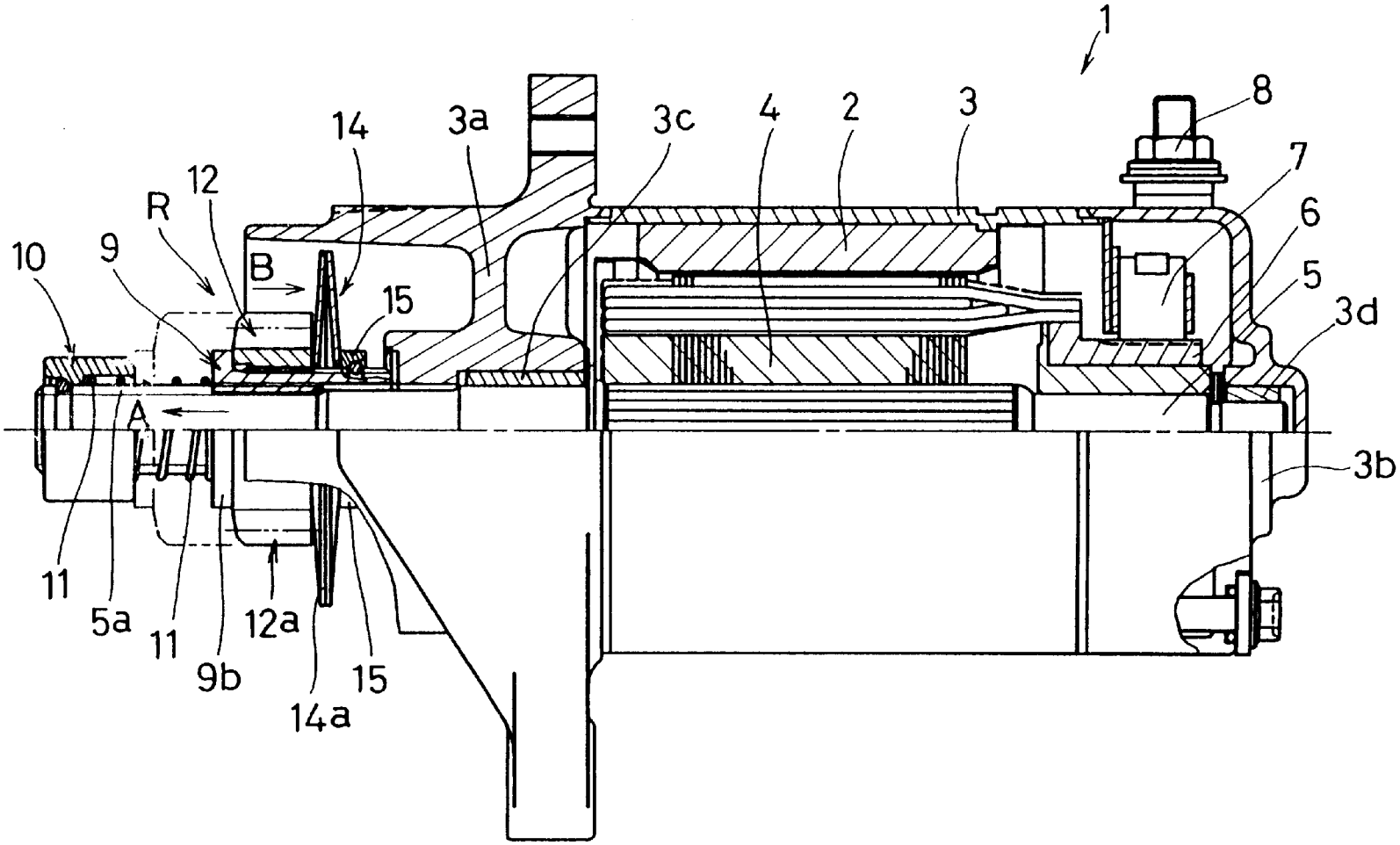
FIG. 1 is a side view showing a partial section of a starter apparatus.
Figure 2:
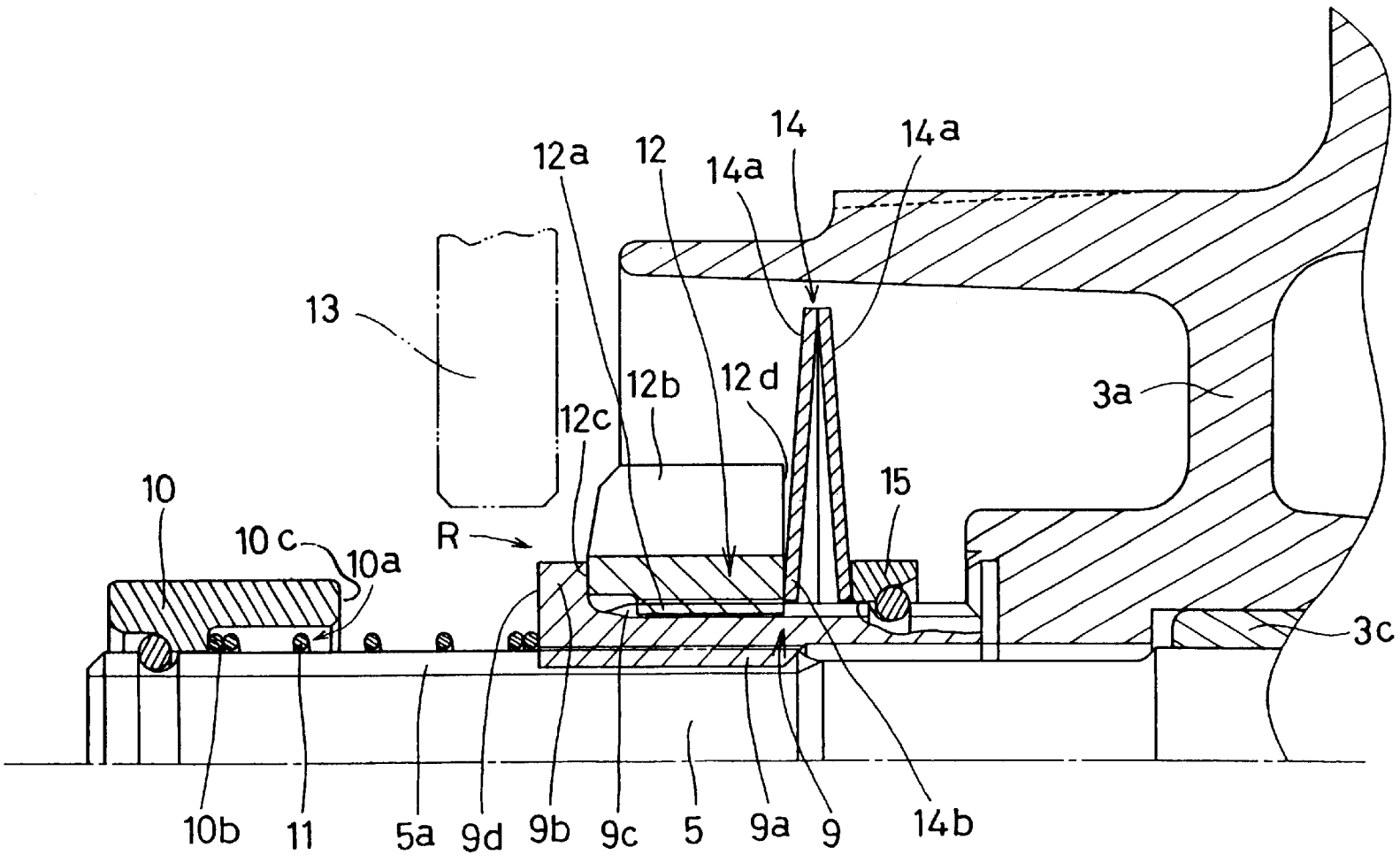
FIG. 2 is an enlarged sectional view showing the major parts where the inner member is positioned at the non-operating position.
Figure 3:
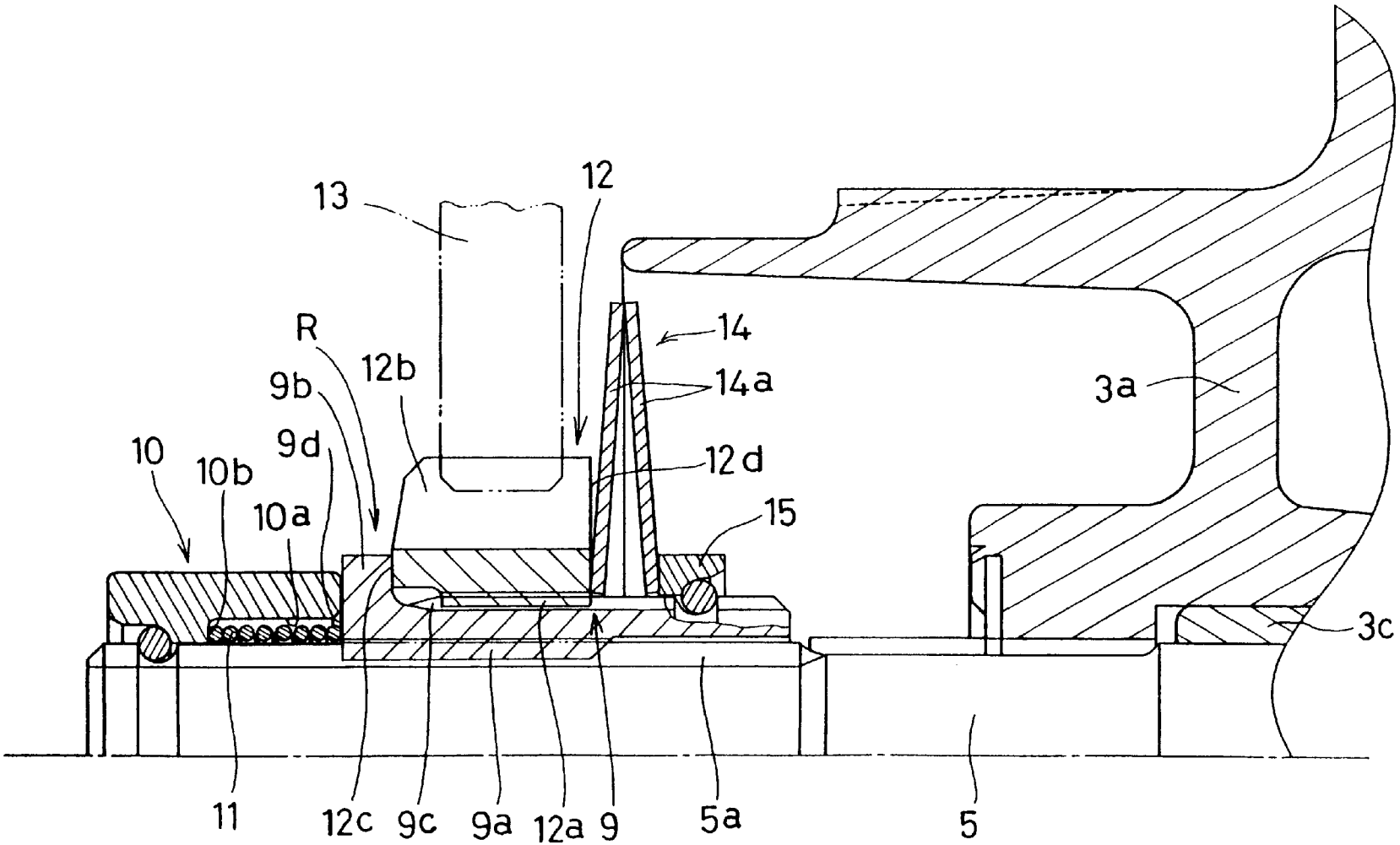
FIG. 3 is an enlarged sectional view showing the major parts where the inner member is positioned at the non-operating position.
Figure 4:
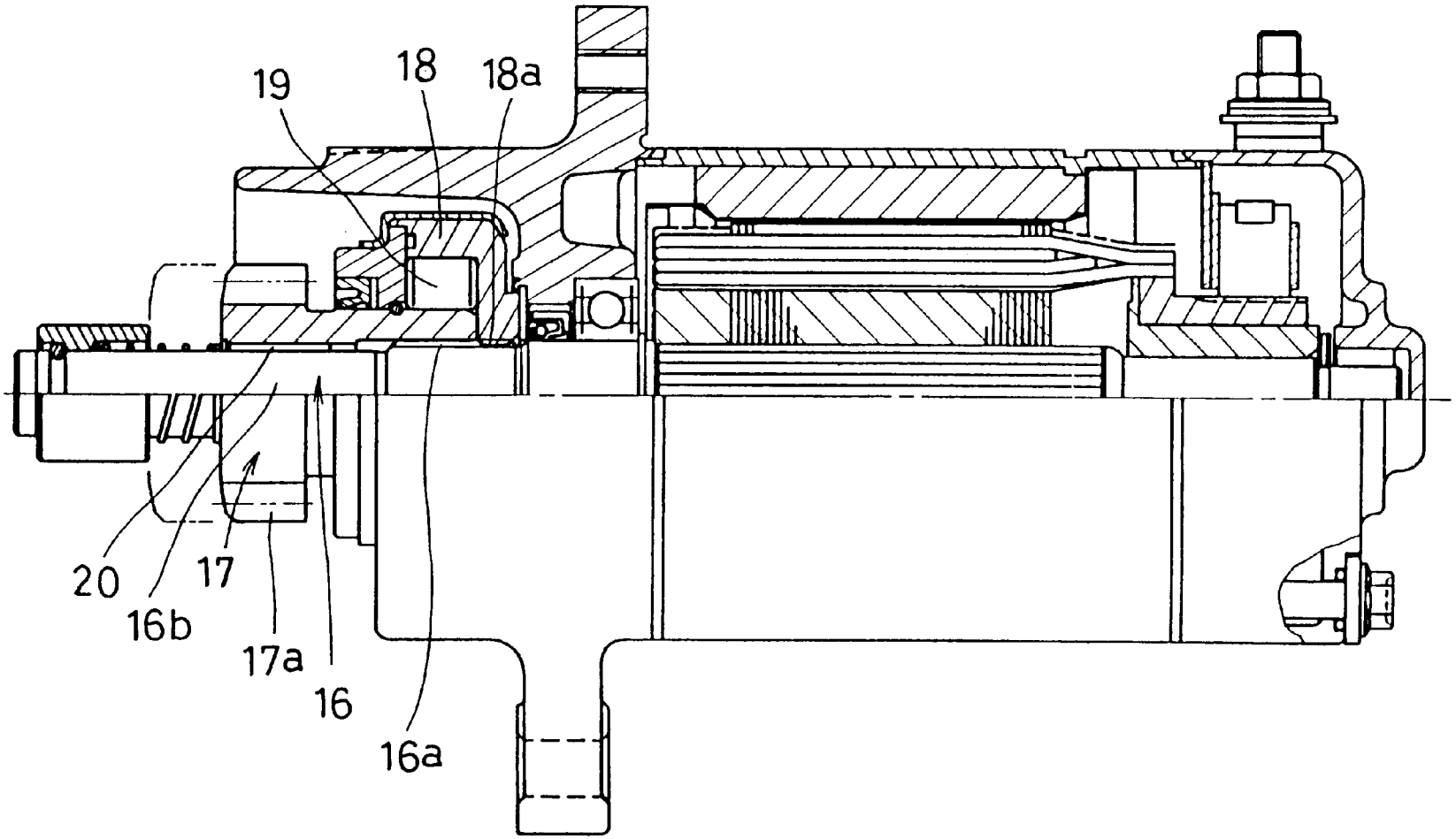
(RELATED ART) Fig. 4
FIG. 4 is a side view showing a partial section of a related art starter apparatus.

Next, a description is given of a preferred embodiment of the invention with reference to the accompanying drawings FIG. 1 through FIG. 3.

In the drawings, 1 indicates a starter motor. The starter motor 1 is provided with an armature (rotor) 4 in a cylindrical casing 3 in which permanent magnets 2 are adhered to the inner cylindrical surface of the casing. The tip end of the armature 4 is rotatably supported in a state where it protrudes outward, penetrating the front bracket 3*a* which covers the end portion of casing 3. The base end of the armature 4 is rotatably supported at the end bracket 3*b* of the casing. In addition, a commutator 6 is fixed at the base end side of the motor shaft 5. A brush 7 slides on the commutator 6, and an external terminal 8 is connected to an external power source to feed electric current to the brush 7. The structure of these components is identical to that in the related arts.

Further, a bearing 3*c* intervenes between the motor shaft 5 and the front bracket 3*a*, and a bearing 3*d* intervenes between the motor shaft 5 and the end bracket 3*b*. A first male helical spline 5*a* is provided on the outer cylindrical surface of the motorshaft 5 projecting from the front bracket 3*a*. A cylindrical inner member 9 having an inner cylindrical surface with a first female helical spline 9*a* is provided whereby the first female spline 9*a* is screwed to its male counterpart 5*a*, such that inner member 9 is screwed onto motor shaft 5 projecting from front bracket 3*a*. This arrangement permits relative movement of the inner member 9 to the motor shaft 5 at this projecting tip end. Further, the inner member 9 is integrally provided with a regulation portion 9*b* protruding like a flange at the tip end side of the inner member, wherein a second male helical spline 9*c*, which is oriented so that its screwing direction is reverse to that of the first male helical spline 5*a*, is provided on the outer circumferential surface of the base end side of the regulation portion 9*b*.

A stopper 10 is fixed at the tip end side of the motor shaft 5 to stop or to regulate movement of the inner member 9 as screwed into the motor shaft 5, whereby the inner member 9 is set to move from the non-operating position (FIG. 2) where the base end side of the inner member 9 is brought into contact with the front bracket 3*a* to the operating position (FIG. 3) where the tip end side 9*d* of the inner member is brought into contact with the base end side 10*c* of the stopper 10. In addition, a concave grooved portion 10*a* is provided in the stopper 10 to extend from the base end side 10*c* of the stopper 10 to the tip end portion of a coil resilient means 11. The concave grooved portion 10*a* is externally fitted to the first male helical spline 5*a* of the motor shaft, which spline 5*a* is accommodated in the corresponding concave portion 10*a*. Herein, the screwing direction of the coil resilient means 11 is opposed to the first male helical spline 5*a*, whereby it is devised that the coil resilient means 11 does not drop in the screw groove of the first male helical spline 5*a*.

Subsequently, the coil resilient means 11 causes its tip end side to be brought into contact with and supported at the bottom portion 10*b* of the concave grooved portion 10*a*, and causes its base end portion to be brought into contact with and supported at the tip end side end portion 9*d* of the inner member 9, whereby it is set that the inner member 9 is pressed toward the front bracket 3*a*.

Also, the outer member 12, having a second female helical spline 12*a* provided on the inner circumferential surface of said outer member, is screwed in and built into the second male helical spline 9*c* on the outer circumference of the inner member 9, and a pinion gear 12*b* is integrally formed on the outer circumference of the corresponding outer member 12. As described later, the pinion gear 12*b* is set so as to be engaged with a ring gear, which is a driven gear, when the inner member 9 advances along with the outer member 12 and reaches the operating position on the tip end side of the motor shaft.

Further, the outer member 12 is formed to be shorter in its axial length than that of the inner member 9, wherein when the tip end side 12*c* of the outer member 12 is screwed and set in a state such that it comes into collision with the base end side surface of the regulation portion 9*b* of the inner member 9, the outer member 12 is permitted to have a marginal portion in which the outer member 12 moves relative to the base end side on the inner member 9. In the corresponding marginal portion, a pressing mechanism 14 which presses the outer member 12 toward the tip end side of the start motor, intervenes between the base end side surface 12*d* of the outer member in the set state and the inner member 9. The pressing mechanism 14 may be a pair of coned disk springs 14*a* which are idly fitted on the outer circumference of the inner member 9 and are juxtaposed to each other in the axial direction so that their concave portions overlap each other. By the coned disk spring 14*a* at the base end side being stopped by a circlip 15 fixed on the outer circumference of the inner member, the coned disk spring 14*a* presses the outer member 12 toward the regulation portion 9*b* side or tip end of the starter motor. Relative movement of the outer member 12 via the second male and female helical, splines 9*c* and 12*a* respectively, is carried out against the pressing mechanism 14. To the contrary, in the relative movements thereof toward the tip end side of the starter motor, the outer member 12 receives movement regulation by the inner member regulation portion 9*b*. Therefore, the outer member 12 is set so that a force operates so as to move the inner member 9 toward the tip end side along with said outer member 12. Further, because the outer diameter of the coned disk spring 14*a* is made greater than the diameter of the outer member 12, then the inner edge portion 14*b* of the coned disk spring 14*a* that is positioned closest to the tip end side presses the base end surface 12*d* of the outer member 12 towards the tip end of the starter motor.

As the motor shaft 5 of the starter motor 1 starts rotating based on the starting operation (key operation) of an engine, the inner member 9 starts to slide with inertia, that is, advances and moves toward the tip end side (the direction of the arrow A in FIG. 1) on the motor shaft 5 via the first male and first female helical splines 5*a*, 9*a*, respectively, before finally it moves to the operating position where the inner member is brought into contact with the tip end side 10*c* of the stopper 10, at which time the inner member 9 rotates integral with (that is, in synchronization with) the motor shaft 5 such that the inner member 9 is subjected to movement regulation provided by the stopper 10 that precludes the inner member from moving toward the tip end side any further. In this case, when the inner members movement is stopped by stopper 10, the outer member 12 attempts to move in retreat in the direction opposite to the previously advancing movement of the inner member 9. That is, the outer member 12 begins retreating in the direction of Arrow B, in FIG. 1, and against the pressing mechanism 14. An impact that normally occurs when the pinion gear 12*b* is engaged with the ring gear 13 can be relieved, therefore, when the outer member's attempt to retreat is balanced with the pressing force of the pressing mechanism 14, which causes the outer member 12 to rotate along with the inner member 9. Thus, a rotating mechanism R composed of the pinion gear 12*b*, outer member 12, and inner member 9 rotates integral with the motor shaft 5, and causes the ring gear 13 to be forcibly rotated.

Next, while the ring gear 13 is subjected to forcible rotation, should the rotation of the ring gear 13 exceed that of the pinion gear 12*b*, any rotation excess of the ring gear 13 is given to the pinion gear 12*b*, whereby although the inner member 9 attempts to retreat to the base end direction (the direction of the arrow B) via the first male and female helical splines 5*a*, 9*a*, respectively, upon receiving the load, lie total force given in the tip end direction (the direction of the arrow A) resulting from the outer member 12 connection to the inner member 9 via the second helical splines 9*c*, 12*a* and their being reversely screwed, causes the inner member 9 to advance instead, and a pressing force of the pressing mechanism, which presses the outer member 12 toward the tip end side, operates on the inner member 9. Therefore, the inner member 9 can be prevented from quickly returning along with the pinion gear 12*b* and the outer member 12.

As the engine starts, the ring gear 13 is driven in a stable state, the starter motor 1 stops, and the motor shaft 5 stops rotating. In line therewith, the rotating mechanism R carries out a retreat based on the inertia slide via the first male and female helical splines 9*a*, 5*a* between the inner member 9 and the motor shaft 5 while receiving a pressing force provided by the coil resilient means 11, whereby the rotating mechanism R returns to the non-operating position.

In the preferred embodiment of the invention, which is structured as described above, as the starter motor 1 is driven, the inner member 9 constituting the rotating mechanism R performs an inertia slide and moves to advance, and the pinion gear 12*b* is engaged with the ring gear 13, whereby forcible drive of the ring gear 13 is carried out. In this case, as described above, the first male and female helical splines 5*a*, 9*a*, respectively, intervene between the motor shaft 5 and the inner member 9 to effect a first direction of movement, and the second male and female helical splines 9*c*, 12*a* intervene between the inner member 9 and the outer member 12 to effect reverse direction of movement. For this reason, when the pinion gear 12*b* is engaged with the ring gear 13, a quick return in the case where the rotation of the ring gear 13 side exceeds that of the pinion gear 12*b* can be prevented by the total force of a force of the outer member 12 which attempts to relatively move in the advancing direction with respect to the inner member 9 and a pressing force of the pressing mechanism 14 in addition to absorption of an impact. Accordingly, a quick return preventing means, such as a one-way rotation clutch, need not be additionally provided, whereby the number of components is reduced, the construction is simplified, and assembly efficiency is improved.

Moreover, because the inner member 9 is structured so that the first male helical spline 5*a* is provided to the tip end beyond the area of advancement and retreat of the inner member 9, it is not necessary to provide an axial portion of the motor shaft whose diameter is smaller or different than the diameter of the corresponding helical spline, located at the tip end as in the prior arts. Therefore, the motor shaft 5 is strengthened, and play in the motor shaft 5 is reduced with respect to high-speed rotation. Further, material costs are reduced, and the cutting work to manufacture the motor shaft can be simplified, whereby production costs thereof can be remarkably reduced.

What is claimed is:

1. A one-axis starter motor apparatus having a tip end and a base end, comprising:

a motor shaft having an axial portion between the tip and base ends;

a helical spline portion at one of the tip and base ends;

an inner member externally fitted to the motor shaft of the starter motor via a first helical spline on an inner periphery of the inner member and mated to the helical spline portion at the one of the tip and base ends so as to freely advance and retreat;

an outer member having a helical spline portion on an inner periphery of the outer member, on which outer member a pinion gear disengageably engaged with a driven ring gear on the basis of the advancement and retreat of the inner member is formed, the outer member being externally fitted to an outer periphery of the inner member; and a pressing means, wherein the outer member is urged toward the driven ring gear side by the pressing means in a state where the outer member's movement relative to the driven ring gear side is regulated with respect to the inner member, and wherein the outer member is externally fitted to the inner member via a second helical spline provided on the outer periphery of the inner member and mated to the helical spline portion on the inner periphery of the outer member which are reversely oriented from the first helical spline.

2. The one-axis starter motor apparatus as set forth in claim 1, wherein the first helical spline of the motor shaft is provided at the tip end of the motor shaft beyond the area of advancement and retreat of the inner member.

3. The one-axis starter motor apparatus as set forth in claim 1, wherein the pressing means is composed of two overlapped coned disk springs.

4. The one-axis starter motor apparatus as set forth in claim 2, wherein the pressing means is composed of two overlapped coned disk springs.

5. The one-axis starter motor apparatus as set forth in claim 1, wherein the motor shaft is of a constant diameter at its axial portion.

6. The one-axis starter motor apparatus as set forth in claim 1, wherein a stopper is provided for regulating the advancement of the inner member.

7. A starter motor apparatus, comprising:

a motor shaft having opposed tip and base ends with a first helical spline portion having a first screwing orientation at the tip end of the shaft;

a movable inner member coaxial with and externally concentric about the shaft and having a second helical spline portion mated to the first helical spline portion;

a regulation portion protruding as a flange at a tip end side of the inner member and extending from the inner member towards a base end side of the inner member, the regulation portion having a third helical spline portion reversely oriented for movement from the second helical spline;

an outer member coaxial with and externally concentric about the inner member and having a fourth helical spline portion mated to the reversely oriented third helical spline portion of the inner member's regulation portion;

a pressing means for urging the outer member's movement relative to the inner member toward engagement with a ring gear;

a pinion gear extending radially from the outer member; and the ring gear engageable with the pinion gear.

8. The starter motor of claim 7, wherein the shaft has an axial portion of constant diameter between the opposed tip and base ends.

9. The starter motor of claim 7, wherein the first helical spline portion is male.

10. The starter motor of claim 9, wherein the second helical spline portion is female such that it engagingly receives the first helical spline portion.

11. The starter motor of claim 7, wherein the third helical spline portion is male.

12. The starter motor of claim 11, wherein the fourth helical spline portion is female such that it engagingly receives the third helical spline portion for threadedly moving the inner member in a direction reverse to the engagement of the first and second helical spline portions.

* * * * *